US011608612B2

(12) United States Patent
Nakamura et al.

(10) Patent No.: US 11,608,612 B2
(45) Date of Patent: Mar. 21, 2023

(54) HYDRAULIC UNIT

(71) Applicant: DAIKIN INDUSTRIES, LTD., Osaka (JP)

(72) Inventors: Hirokazu Nakamura, Osaka (JP); Atsuhiro Kanbayashi, Osaka (JP); Hitoshi Segawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/760,718

(22) PCT Filed: Sep. 2, 2020

(86) PCT No.: PCT/JP2020/033329
§ 371 (c)(1),
(2) Date: Mar. 15, 2022

(87) PCT Pub. No.: WO2021/054124
PCT Pub. Date: Mar. 25, 2021

(65) Prior Publication Data

US 2022/0333349 A1 Oct. 20, 2022

(30) Foreign Application Priority Data

Sep. 17, 2019 (JP) ..... JP2019-168489

(51) Int. Cl.
*F15B 19/00* (2006.01)
*F15B 20/00* (2006.01)
(Continued)

(52) U.S. Cl.
CPC ..... *E02F 9/2228* (2013.01); *F15B 1/26* (2013.01); *F15B 19/005* (2013.01);
(Continued)

(58) Field of Classification Search
CPC ..... F15B 11/08; F15B 19/005; F15B 20/00; F15B 20/005; F15B 2211/20515;
(Continued)

(56) References Cited

U.S. PATENT DOCUMENTS 11,365,828 B2 * 6/2022 Jagoda ..... F15B 19/005

FOREIGN PATENT DOCUMENTS

JP 2010-96324 A 4/2010
JP 2011-231924 A 11/2011
(Continued)

OTHER PUBLICATIONS

International Search Report of corresponding PCT Application No. PCT/JP2020/033329 dated Oct. 27, 2020.
(Continued)

*Primary Examiner* — Michael Leslie
(74) *Attorney, Agent, or Firm* — Global IP Counselors, LLP

(57) ABSTRACT

A hydraulic unit includes a hydraulic circuit fluidly connected to a hydraulic actuator, and a control device to control the hydraulic circuit. The hydraulic circuit includes a hydraulic oil tank, a hydraulic pump that supplies the hydraulic oil to the hydraulic actuator from the hydraulic oil tank, a discharge flow path fluidly connecting a discharge side of the hydraulic pump to the hydraulic actuator, a valve that blocks a flow of the hydraulic oil in the discharge flow path, and a pressure sensor that detects a pressure of the hydraulic oil the discharge flow path. In a pressure holding state, when a rotational frequency of the hydraulic pump exceeds a predetermined first determination rotational frequency or when a discharge flow rate of the hydraulic pump exceeds a predetermined first determination discharge flow rate, the control device determines that the hydraulic circuit is abnormal.

17 Claims, 7 Drawing Sheets

(51) Int. Cl.

| | |
|---|---|
| ***F15B 11/08*** | (2006.01) |
| ***E02F 9/22*** | (2006.01) |
| ***F15B 1/26*** | (2006.01) |
| *F15B 13/04* | (2006.01) |

(52) U.S. Cl.
CPC ..... *F15B 20/004* (2013.01); *F15B 11/08* (2013.01); *F15B 13/0401* (2013.01); *F15B 2211/20515* (2013.01); *F15B 2211/20538* (2013.01); *F15B 2211/20546* (2013.01); *F15B 2211/30505* (2013.01); *F15B 2211/40515* (2013.01); *F15B 2211/411* (2013.01); *F15B 2211/41509* (2013.01); *F15B 2211/41563* (2013.01); *F15B 2211/45* (2013.01); *F15B 2211/633* (2013.01); *F15B 2211/634* (2013.01); *F15B 2211/6309* (2013.01); *F15B 2211/6343* (2013.01); *F15B 2211/7053* (2013.01); *F15B 2211/855* (2013.01); *F15B 2211/857* (2013.01)

(58) Field of Classification Search
CPC ..... F15B 2211/634; F15B 2211/6343; F15B 2211/855; F15B 2211/857
See application file for complete search history.

(56) References Cited

FOREIGN PATENT DOCUMENTS

| | | | |
|---|---|---|---|
| JP | 2012-97822 | A | 5/2012 |
| JP | 2013-253674 | A | 12/2013 |
| JP | 2019-49204 | A | 3/2019 |

OTHER PUBLICATIONS

International Preliminary Report of corresponding PCT Application No. PCT/JP2020/033329 dated Mar. 31, 2022.
European Search Report of corresponding EP Application No. 20 86 5653.8 dated Aug. 4, 2022.

* cited by examiner

HYDRAULIC UNIT

CROSS-REFERENCE TO RELATED APPLICATIONS

This U.S. National stage application claims priority under 35 U.S.C. §119(a) to Japanese Patent Application No. 2019468489, filed in Japan on Sep. 17, 2019, the entire contents of which are hereby incorporated herein by reference.

BACKGROUND

Field of the Invention

The present disclosure relates to hydraulic units.

Background Information

Some conventional hydraulic units include a hydraulic circuit having a fluid tank, a. fluid pressure pump that supplies the fluid in the fluid tank to a fluid pressure actuator, and a variable speed motor that drives the fluid pressure pump (see JP 2010-96324 A). Furthermore, this hydraulic unit includes an abnormality warning unit that Warns of an abnormality when a rotational frequency of the variable speed motor, in a state in which a discharge pressure is controlled to a constant value (pressure holding state), exceeds a predetermined reference value.

SUMMARY

However, in the above-described conventional hydraulic unit, a hydraulic circuit of a main machine, such as a machine tool or a press machine, is connected to the discharge side of the hydraulic circuit, so that there is a problem that it is impossible to identify in which of the hydraulic circuits of the hydraulic unit and the main machine there occurs abnormality that causes a change in the rotational frequency of the variable speed motor in the pressure holding state.

The present disclosure proposes a hydraulic unit capable of identifying the abnormality of a hydraulic circuit of the hydraulic unit.

A hydraulic unit of the present disclosure includes a hydraulic circuit fluidly connected to a hydraulic actuator, and a control device configured to control the hydraulic circuit. The hydraulic circuit includes a hydraulic oil tank configured to store hydraulic oil, a hydraulic pump configured to supply the hydraulic oil to the hydraulic actuator from the hydraulic oil tank, a discharge flow path that fluidly connects a discharge side of the hydraulic pump and the hydraulic actuator, a valve configured to block a flow of the hydraulic oil in the discharge flow path, and a pressure sensor configured to detect a pressure of the hydraulic oil in a flow path portion, between the valve and the hydraulic pump, of the discharge flow path. When a rotational frequency of the hydraulic pump exceeds a predetermined first determination rotational frequency or when a discharge flow rate of the hydraulic pump exceeds a predetermined first determination discharge flow rate, in a pressure holding state in which the hydraulic pump is controlled such that the pressure detected by the pressure sensor is held at a predetermined pressure while the valve is blocking the flow of the hydraulic oil, the control device determines that the hydraulic circuit is abnormal.

According to the present disclosure, while the valve is blocking the discharge flow path that fluidly connects the discharge side of the hydraulic pump and the hydraulic actuator, the control device determines, by the rotational frequency or the discharge flow rate of the hydraulic pump, whether the hydraulic circuit is abnormal or not. As a result, the abnormality of the hydraulic circuit can be identified from a change in the rotational frequency or the discharge flow rate of the hydraulic pump.

An increase in the rotational frequency of the hydraulic pump in the pressure holding state is caused by a leak of the hydraulic oil in the hydraulic pump. Therefore, according to the embodiment, when the control device determines that the hydraulic circuit is abnormal based on the rotational frequency of the hydraulic pump in the pressure holding state exceeding the predetermined first determination rotational frequency, it can be identified that the hydraulic oil leaks in the hydraulic pump.

The hydraulic unit of an embodiment includes a leakage flow path that fluidly connects the flow path portion of the discharge flow path to the hydraulic oil tank.

When the hydraulic pump is operated at a low rotational frequency, the drive torque of the hydraulic pump generally becomes unstable, and pressure control/flow rate control may become unstable. In the embodiment, the hydraulic unit includes a leakage flow path that fluidly connects the flow path portion of the discharge flow path to the hydraulic oil tank, so that a part of the fluid discharged from the hydraulic pump passes through the leakage flow path to flow into the hydraulic oil tank. As a result, the discharge flow rate of the hydraulic pump becomes larger than a flow rate required by the hydraulic actuator, and the hydraulic pump is operated at a higher rotational frequency than when the leakage flow path is not provided. As a result, the stability of the drive torque of the hydraulic pump is improved, and stable pressure control/low rate control can be performed.

In an embodiment, when the rotational frequency of the hydraulic pump becomes less than a predetermined second determination rotational frequency lower than the first determination rotational frequency or when the discharge flow rate of the hydraulic pump becomes less than a predetermined second determination discharge flow rate lower that the first determination discharge flow rate, in the pressure holding state, the control device determines that the hydraulic circuit is abnormal.

A decrease in the rotational frequency of the hydraulic pump in the pressure holding state is caused by clogging of the leakage flow path. According to the embodiment, when determining that the hydraulic circuit is abnormal based on the rotational frequency of the hydraulic pump in the pressure holding state becoming less than the predetermined second determination rotational frequency, the control device can identify that there is clogging in the leakage flow path.

In an embodiment, the valve is configured to send to the control device monitor signal indicating an operating state of the valve.

According to the embodiment, the control device determines, by using the monitor signal indicating an operating state of the valve, whether the hydraulic circuit is abnormal or not while the valve is reliably is blocking the flow of the hydraulic oil, so that the determination can be improved in reliability.

The hydraulic unit of an embodiment includes a motor configured to drive the hydraulic pump, and a motor detector configured to detect a motor current of the motor or a winding temperature of the motor. The control device determines in the pressure holding state whether the hydraulic circuit is abnormal based on the motor current of the motor or the winding temperature of the motor detected by the motor detector.

According to the embodiment, the abnormality of the hydraulic circuit is determined from the motor current or the winding temperature of the motor as well as the determination of the abnormality of the hydraulic circuit based on the rotational frequency or discharge flow rate of the hydraulic pump. As a result, the determination of the abnormality of the hydraulic circuit can be improved in accuracy.

In an embodiment, the control device is able to execute flow rate control in which the rotational frequency of the hydraulic pump is controlled such that the discharge flow rate of the hydraulic pump becomes a flow rate set value. When the rotational frequency of the hydraulic pump changes, in the pressure holding state, with respect to a normal rotational frequency corresponding to the predetermined pressure, the control device corrects the flow rate set value depending on the change in the rotational frequency of the hydraulic pump with respect to the normal rotational frequency.

According to the embodiment, the hydraulic pump can supply the hydraulic oil at a desired flow rate to the hydraulic actuator, so that a decrease in the performance of the hydraulic actuator can be suppressed.

In an embodiment, the valve is a shut-off valve.

According to the embodiment, a shut-off valve with less leakage than other valves is used, so that the determination of the abnormality of the hydraulic circuit by the control device can be improved in reliability.

DETAILED DESCRIPTION OF EMBODIMENT(S)

Hereinafter, hydraulic units according to embodiments of the present disclosure will be described with reference to the accompanying drawings.

FIRST EMBODIMENT

Figure 1:
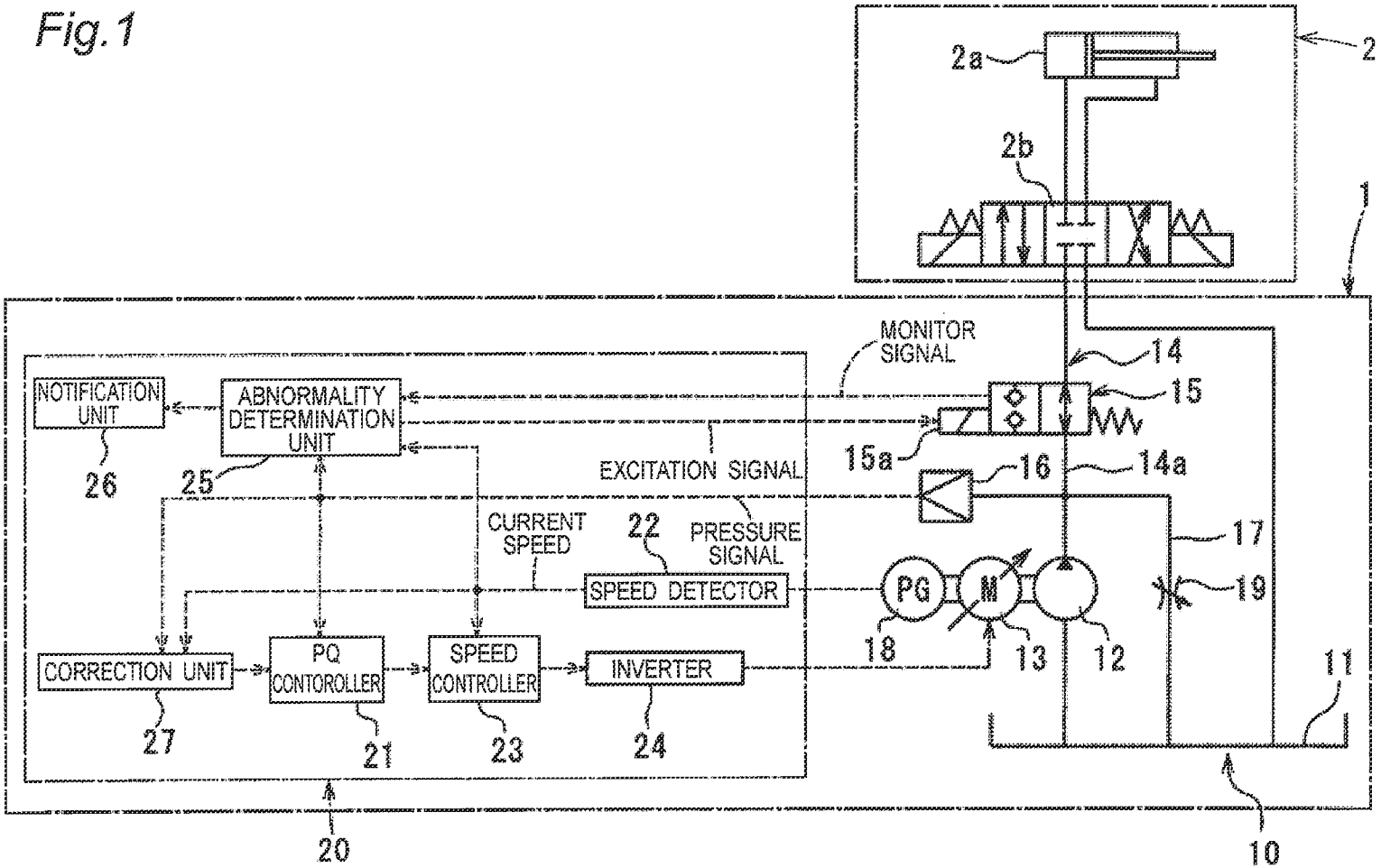
FIG. 1 is a circuit diagram showing a configuration of a hydraulic unit according to a first embodiment of the present disclosure.

FIG. 1 is a circuit diagram showing a configuration of a hydraulic unit according to a first embodiment of the present disclosure.

With reference to FIG. 1, a hydraulic unit 1 of the present embodiment is configured to be fluidly connected to a main machine 2 such as a machine tool (e.g., a press machine). The main machine 2 includes a hydraulic circuit having a hydraulic actuator 2*a*, such as a cylinder or a motor, and a direction-switching valve 2*b*. The hydraulic unit 1 is fluidly connected to the hydraulic actuator 2*a* via the direction-switching valve 2*b*. The hydraulic unit 1 is configured to supply hydraulic oil to the hydraulic actuator 2*a* to drive the hydraulic actuator 2*a*.

The hydraulic unit 1 includes a hydraulic circuit 10 configured to be fluidly connected to the hydraulic actuator 2*a* and a control device 20 that controls the hydraulic circuit 10.

(Hydraulic Circuit)

The hydraulic circuit 10 includes a hydraulic oil tank 11 that stores the hydraulic oil, a hydraulic pump 12 that supplies the hydraulic oil to the hydraulic actuator 2*a* from the hydraulic oil tank 11, and a motor 13 that drives the hydraulic pump 12. In addition, the hydraulic circuit 10 includes a discharge flow path 14 that fluidly connects a discharge side of the hydraulic pump 12 to the hydraulic actuator 2*a*. The hydraulic circuit 10 includes a valve 15 that blocks a flow of the hydraulic oil in the discharge flow path 14 and a pressure sensor 16 that detects a pressure of the hydraulic oil in a flow path portion 14*a*, between the valve 15 and the hydraulic pump 12, of the discharge flow path 14. In addition, the hydraulic circuit 10 includes a leakage flow path 17 that fluidly connects the flow path portion 14*a* of the discharge flow path 14 to the hydraulic oil tank 11.

The hydraulic pump 12 of the present embodiment is a fixed displacement pump that sucks the hydraulic oil in the hydraulic oil tank 11 and discharges the hydraulic oil.

The motor 13 is a variable speed motor that is mechanically connected to the hydraulic pump 12 to drive the hydraulic pump 12. The motor 13 is an interior permanent magnet (IPM) motor. A pulse generator 18 is connected to the motor 13. The pulse generator 18 outputs a pulse signal indicating the rotational speed of the motor 13.

The discharge flow path 14 is fluidly connected to the hydraulic actuator 2*a* via the direction-switching valve 2*b*. In addition, a flow path portion 14*a* of the discharge flow path 14 is defined between the hydraulic pump 12 and the valve 15. In other words, the flow path portion 14*a* of the discharge flow path 14 is a portion, located between the hydraulic pump 12 and the valve 15, of the discharge flow path 14.

The valve 15 of the present embodiment is an electromagnetic solenoid-operated shut-off valve. The valve 15 allows the flow of the hydraulic oil in the discharge flow path 14 when a solenoid 15*a* is demagnetized, and blocks the flow of the hydraulic oil in the discharge flow path 14 when the solenoid 15*a* is excited. The valve 15 is provided on the discharge flow path 14. The valve 15 outputs a monitor signal indicating an operating state of the valve 15.

The pressure sensor 16 detects the pressure of the hydraulic oil in the flow path portion 14*a* of the discharge flow path 14, and outputs a pressure signal. In other words, the pressure sensor 16 detects a discharge pressure of the hydraulic pump 12 and outputs a pressure signal.

The leakage flow path 17 is configured such that a part of the hydraulic oil discharged from the hydraulic pump 12 flows into the hydraulic oil tank 11 without being supplied to the hydraulic actuator 2*a*. A flow rate control valve 19 is provided on the leakage flow path 17. The flow rate control valve 19 adjusts the flow rate of the hydraulic oil flowing into the hydraulic oil tank 11 through the leakage flow path 17. The flow rate control valve 19 is a variable throttle valve.

(Control Device)

The control device 20 includes a PQ controller 21, a speed detector 22, a speed controller 23, an inverter 24, an abnormality determination unit 25, a notification unit 26, and a correction unit 27.

The pressure signal detected by the pressure sensor 16 is input to the PQ controller 21. The PQ controller 21 outputs a speed command based on the pressure signal that has been input and the discharge pressure-discharge flow rate characteristic (hereinafter referred to as P-Q characteristic) shown in FIG. 2.

The pulse signal is input to the speed detector 22 from the pulse generator 18. The speed detector 22 detects, as a current speed, the number of revolutions per unit time (hereinafter referred to as rotational frequency) of the motor 13 by measuring an input interval of the pulse signal, and outputs a speed signal.

To the speed controller 23, the speed command is input from the PQ controller 21 and the speed signal is input from the speed detector 22. The speed controller 23 performs a speed control calculation using the speed command and the speed signal that have been input, and outputs a current command.

The current command is input to the inverter 24 from the speed controller 23. The inverter 24 controls the rotational frequency of the motor 13 by outputting a drive signal to the motor 13 based on the current command that has been input.

Figure 2:
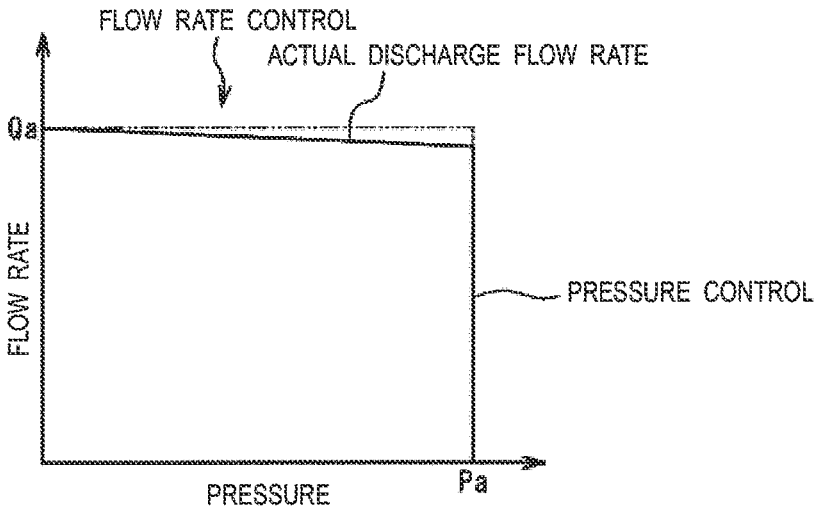
FIG. 2 is a discharge pressure-discharge flow rate characteristic diagram of a hydraulic pump according to the first embodiment.

In the present embodiment, the PQ controller 21, the speed controller 23, and the inverter 24 perform, based on the P-Q characteristic shown in FIG. 2, flow rate control (constant flow rate control) arid pressure control (constant pressure control) of the hydraulic pump 12 by switching from one to the other. FIG. 2 is a diagram showing the discharge pressure-discharge flow rate characteristic of the hydraulic unit 1 of the present embodiment.

With reference to FIG. 2, in the flow rate control, the rotational frequency of the motor 13 (rotational frequency of the hydraulic pump 12) is controlled such that the discharge flow rate of the hydraulic pump 12 becomes a flow rate set value Qa. In the present embodiment, the hydraulic pump 12 is a fixed displacement pump, so that the discharge flow rate of the hydraulic pump 12 is obtained by the product of the pump displacement (discharge flow amount per revolution) and the rotational frequency of the motor 13.

In the flow rate control, a rotational frequency of the motor 13 (rotational frequency of the hydraulic pump) is set such that the discharge flow rate of the hydraulic pump 12 becomes the flow rate set value Qa at each discharge pressure. The rotational frequency of the motor 13 is controlled to become the rotational frequency that has been set. Therefore, in the flow rate control, the actual discharge flow rate becomes less than the flow rate set value Qa as a load pressure becomes higher even in a normal state, due to a pump volumetric efficiency and by an amount of leakage of the hydraulic oil in the hydraulic circuit 10, as shown in FIG. 2.

In the pressure control, the rotational frequency of the motor 13 (rotational frequency of the hydraulic pump 12) is controlled such that the discharge pressure of the hydraulic pump 12 becomes a pressure set value Pa.

In addition, with reference to FIG. 1, to the abnormality determination unit 25, the pressure signal (discharge pressure) is input from the pressure sensor 16 and the speed signal (rotational frequency of the motor 13) is input from the speed detector 22. The abnormality determination unit 25 determines a state of the hydraulic circuit 10 of the hydraulic unit 1 based on the discharge pressure that has been input and the rotational frequency of the hydraulic pump 12 obtained from the rotational frequency of the motor 13 that has been input.

The abnormality determination unit 25 of the present embodiment outputs an excitation signal that drives the solenoid 15*a* of the valve 15. On the other hand, the monitor signal indicating the operating state of the valve 15 is input to the abnormality determination unit 25 from the valve 15.

A determination result of the state of the hydraulic circuit 10 by the abnormality determination unit 25 is input to the notification unit 26 of the present embodiment. When the determination result of the state of the hydraulic circuit 10 input from the abnormality determination unit 25 indicates that the hydraulic circuit 10 is abnormal, the notification unit 26 notifies a user of the abnormality of the hydraulic circuit 10. The notification unit 26 of the present embodiment is a display unit such as an operation panel (not shown) of the hydraulic unit 1, and by displaying that the hydraulic circuit 10 is abnormal, the abnormality of the hydraulic circuit 10 is notified to a user. Alternatively, the notification unit 26 may be an audio output unit such as a speaker (not shown) of the hydraulic unit 1. In this case, the notification unit 26 may notify a user of the abnormality of the hydraulic circuit 10 by outputting audio. Alternatively, the abnormality determination unit 25, for example, may output the determination result of the state of the hydraulic circuit 10 to the outside (e.g., controller on the main machine 2 side).

To the correction unit 27, the pressure signal (discharge pressure) is input from the pressure sensor 16 and the speed signal (rotational frequency of the motor 13) is input from the speed detector 22. The correction unit 27 corrects the flow rate set value Qa for the hydraulic unit 1.

(Determination of State of Hydraulic Circuit)

The control device 20 according to the present disclosure determines the state of the hydraulic circuit 10 by the abnormality determination unit 25 in the pressure holding state using the pressure control. The pressure holding state is a state in which the control device 20 controls the hydraulic pump 12 such that the discharge pressure detected by the pressure sensor 16 is held at a predetermined pressure while the valve 15 is blocking the flow of the hydraulic oil in the discharge flow path 14.

First, the abnormality determination unit 25 outputs the excitation signal to the valve 15. When the solenoid 15*a* is excited by the excitation signal, the valve 15 blocks the flow of the hydraulic oil in the discharge flow path 14. At this time, the monitor signal input to the abnormality determination unit 25 from the valve 15 indicates that the valve 15 is blocking the flow of the hydraulic oil in the discharge flow path 14. In addition, the PQ controller 21, the speed controller 23, and the inverter 24 control the rotational frequency of the hydraulic pump 12 such that the discharge pressure of the hydraulic pump 12 becomes constant at the pressure set value Pa. As a result, the hydraulic unit 1 is put into the pressure holding state. In the present embodiment, when the monitor signal indicates in the pressure holding state that the operating state of the valve 15 is blocking the flow of the hydraulic oil in the discharge flow path 14, the abnormality determination unit 25 determines whether the hydraulic circuit 10 is abnormal or not.

Figure 3:
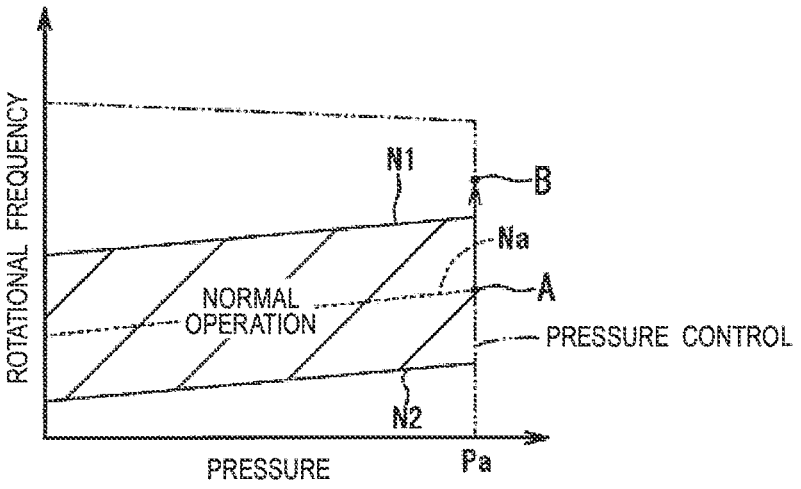
FIG. 3 is a diagram showing a relationship between the discharge pressure and the rotational frequency (discharge flow rate) of the hydraulic pump in a pressure holding state according to the first embodiment.

FIG. 3 is a diagram for explaining the determination of the state of the hydraulic circuit 10 by the abnormality determination unit 25. In FIG. 3, the vertical axis represents the rotational frequency of the hydraulic pump 12. In FIG. 3, the horizontal axis represents the discharge pressure of the hydraulic pump 12.

With reference to FIG. 3, the abnormality determination unit 25 determines in the pressure holding state whether the hydraulic circuit 10 is abnormal or not. Specifically, when the rotational frequency of the hydraulic pump 12 exceeds a predetermined first determination rotational frequency N1 in the pressure holding state, as shown in FIG. 3, the abnormality determination unit 25 of the present embodiment determines that the hydraulic circuit 10 is abnormal.

When it is determined by the abnormality determination unit 25 that the hydraulic circuit 10 is abnormal, the notification unit 26 notifies the abnormality of the hydraulic circuit 10.

An increase in the rotational frequency of the hydraulic pump 12 in the pressure holding state is caused by an increase in a leakage of the hydraulic oil in the hydraulic pump 12. When the leakage of the hydraulic oil in the hydraulic pump 12 increases and the volumetric efficiency of the hydraulic pump 12 decreases, the discharge pressure of the hydraulic pump 12 decreases in the pressure holding state, becoming less than the pressure set value Pa. As a result, the rotational frequency of the hydraulic pump 12 (rotational frequency of the motor 13) is increased by the control device 20 in order to hold the discharge pressure of the hydraulic pump 12 at the pressure set value Pa.

In addition, when the rotational frequency of the hydraulic pump 12 becomes less than a predetermined second determination rotational frequency N2 lower than the first determination rotational frequency N1 in the pressure holding state, the abnormality determination unit 25 of the present embodiment determines that the hydraulic circuit 10 is abnormal.

The decrease in the rotational frequency of the hydraulic pump 12 in the pressure holding state is caused by clogging of the leakage flow path 17. If dust or the like, for example, clogs the flow rate control valve 19 provided on the leakage flow path 17, the flow rate of the hydraulic oil flowing through the leakage flow path 17 decreases. When the flow rate of the hydraulic oil flowing through the leakage flow path 17 decreases, the flow rate of the hydraulic oil to be supplied to the hydraulic actuator 2*a* increases. As a result, the discharge pressure of the hydraulic pump 12 increases in the pressure holding state, exceeding the pressure set value Pa. As a result, the rotational frequency of the hydraulic pump 12 (rotational frequency of the motor 13) is reduced by the control device 20 in order to hold the discharge pressure of the hydraulic pump 12 at the pressure set value Pa.

Furthermore, when the rotational frequency of the hydraulic pump 12 exceeds the predetermined first determination rotational frequency N1 in a state in which the hydraulic pump 12 is controlled to hold the discharge pressure detected by the pressure sensor 16 at a predetermined pressure while the valve 15 is not blocking the flow of the hydraulic oil in the discharge flow path 14, the abnormality determination unit 25 of the present embodiment determines that the hydraulic circuit 10 or any one of the hydraulic circuits of the main machine 2 is abnormal. In this case, the abnormality determination unit 25 of the present embodiment determines whether the hydraulic circuit 10 is abnormal or not in the pressure holding state. When the determination result indicates that the hydraulic circuit 10 is not abnormal, the abnormality determination unit 25 determines that the hydraulic circuit of the main machine 2 is abnormal. The increase in the rotational frequency of the hydraulic pump 12, in the state in which the hydraulic pump 12 is controlled to hold the discharge pressure detected by the pressure sensor 16 at the predetermined pressure while the valve 15 is not blocking the flow of the hydraulic oil in the discharge flow path 14, is caused by, for example, an increase in a leakage of the hydraulic oil in the hydraulic actuator 2*a*. Alternatively, the abnormality determination unit 25 may output to a host control device (not shown) included in the main machine 2 that the hydraulic circuit of the main machine 2 is abnormal.

Similarly, when the rotational frequency of the hydraulic pump 12 becomes less than the predetermined second determination rotational frequency N2 in the state in which the hydraulic pump 12 is controlled to hold the discharge pressure detected by the pressure sensor 16 at the predetermined pressure while the valve 15 is not blocking the flow of the hydraulic oil in the discharge flow path 14, the abnormality determination unit 25 of the present embodiment determines that the hydraulic circuit 10 or any one of the hydraulic circuits of the main machine 2 is abnormal. In this case, the abnormality determination unit 25 of the present embodiment determines whether the hydraulic circuit 10 is abnormal or not in the pressure holding state. When the determination result indicates that the hydraulic circuit 10 is not abnormal, the abnormality determination unit 25 determines that the hydraulic circuit of the main machine 2 is abnormal. The increase in the rotational frequency of the hydraulic pump 12, in the state in which the hydraulic pump 12 is controlled to hold the discharge pressure detected by the pressure sensor 16 at the predetermined pressure while the valve 15 is not blocking the flow of the hydraulic oil in the discharge flow path 14, is caused by, for example, clogging of the hydraulic circuit of the main machine 2. At this time, the abnormality determination unit 25 may output to a host control device (not shown) included in the main machine 2 that the hydraulic circuit of the main machine 2 is abnormal.

(Correction of Flow Rate Set Value)

Figure 4:
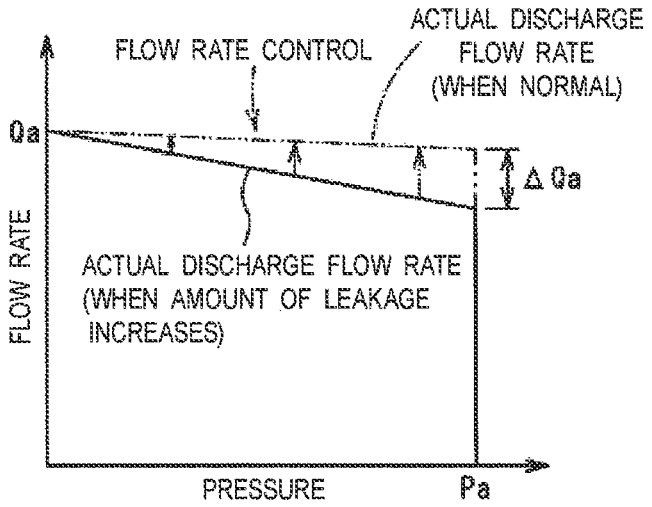
FIG. 4 is a discharge pressure-discharge flow rate characteristic diagram for explaining correction of a flow rate set value of the hydraulic pump according to the first embodiment.

FIG. 4 is a diagram for explaining correction of the flow rate set value Qa by the correction unit 27. If the hydraulic oil leaks in the hydraulic pump 12, the actual discharge flow rate, when the rotational frequency of the hydraulic pump 12 is held constant in the flow rate control, decreases as the discharge pressure increases, as shown in FIG. 4. When the hydraulic oil in the hydraulic pump 12 leaks, the correction unit 27 of the present embodiment suppresses a deviation of the actual discharge flow rate from the flow rate set value Qa by adjusting the flow rate set value Qa in the flow rate control.

The correction unit 27 corrects the flow rate set value Qa based on the discharge pressure of the hydraulic pump 12 input from the pressure sensor 16 and the rotational frequency of the motor 13 detected by the speed detector 22. When the hydraulic circuit 10 is normal, the rotational frequency of the hydraulic pump 12 is controlled to a normal rotational frequency Na such that the discharge pressure of the hydraulic pump 12 in the pressure holding state becomes the pressure set value Pa, as shown by, for example, the point A in FIG. 3. The normal rotational frequency Na of the present embodiment is experimentally obtained when the hydraulic circuit 10 is normal. The first determination rotational frequency N1 is set to be higher than the normal rotational frequency Na by a predetermined rotational frequency. The second determination rotational frequency N2 is set to be lower than the normal rotational frequency Na by a predetermined rotational frequency. When the volumetric efficiency of the hydraulic circuit 10 decreases due to the leakage of the hydraulic oil in the hydraulic pump 12, the rotational frequency of the hydraulic pump 12 in the pressure holding state increases from the normal rotational frequency Na, as shown by the point B in FIG. 3.

When the rotational frequency of the hydraulic pump 12 increases from the normal rotational frequency Na for the pressure set value Pa in the pressure holding state, the correction unit 27 of the present embodiment corrects the flow rate set value Qa depending on a change of the rotational frequency from the normal rotational frequency Na. Even if the hydraulic oil in the hydraulic pump 12 leaks as shown in FIG. 4, the correction unit 27 corrects the flow rate set value Qa such that the actual discharge flow rate is held at a predetermined flow rate in the flow rate control. Specifically, if the hydraulic oil in the hydraulic pump 12 leaks, the correction unit 27 corrects the flow rate set value Qa so as to increase by ΔQa according to the pressure of the hydraulic pump 12 in the flow rate control. As a result, the rotational frequency of the hydraulic pump 12 increases and the actual discharge flow rate increases, so that an influence of the leakage of the hydraulic oil in the hydraulic pump 12 on the P-Q characteristic of the hydraulic unit 1 is suppressed.

According to the present embodiment, the control device 20 determines by the rotational frequency of the pump 12 whether the hydraulic circuit 10 is abnormal or not, while the valve 15 is blocking the flow of the hydraulic oil in the discharge flow path 14 that fluidly connects the discharge side of the hydraulic pump 12 and the hydraulic actuator 2*a*. As a result, the hydraulic pump 12 is fluidly blocked from the hydraulic actuator 2*a*, so that the abnormality of the hydraulic circuit 10 can be identified from a change in the rotational frequency of the hydraulic pump 12 in the pressure holding state.

In addition, the increase in the rotational frequency of the hydraulic pump 12 in the pressure holding state is caused by the leakage of the hydraulic oil in the hydraulic pump 12. Therefore, when determining that the hydraulic circuit 10 is abnormal based on the rotational frequency of the hydraulic pump 12 in the pressure holding state exceeding the predetermined first determination rotational frequency N1, the abnormality determination unit 25 can identify that the hydraulic oil leaks in the hydraulic pump 12.

Furthermore, when the rotational frequency of the hydraulic pump 12 exceeds the predetermined first determination rotational frequency N1 in a state in which the hydraulic pump 12 is controlled to hold the discharge pressure detected by the pressure sensor 16 at a predetermined pressure while the valve 15 is not blocking the flow of the hydraulic oil in the discharge flow path 14, the abnormality determination unit 25 of the present embodiment determines that the hydraulic circuit 10 or any one of the hydraulic circuits of the main machine 2 is abnormal. In this case, the abnormality determination unit 25 of the present embodiment determines whether the hydraulic circuit 10 in the pressure holding state is abnormal or not. When the determination result indicates that the hydraulic circuit 10 is abnormal, it can he identified that the hydraulic oil leaks in the hydraulic pump 12. On the other hand, when the determination result indicates that the hydraulic circuit 10 is not abnormal, it is determined that the hydraulic circuit of the main machine 2 is abnormal. As a result, when there is a change in the rotational frequency of the hydraulic pump 12 in the state in which the hydraulic pump 12 is controlled to hold the discharge pressure detected by the pressure sensor 16 at a predetermined pressure while the valve 15 is not blocking the flow of the hydraulic oil in the discharge flow path 14, it can be identified which of the hydraulic unit 1 and the main machine 2 causes the change.

When the hydraulic pump 12 is operated at a low rotational frequency, the drive torque of the hydraulic pump 12 generally becomes unstable, and the pressure control/flow rate control may become unstable. In the present embodiment, the hydraulic unit 1 includes the leakage flow path 17 that fluidly connects the flow path portion 14*a* of the discharge flow path 14 and the hydraulic oil tank 11, so that a part of the fluid discharged from the hydraulic pump 12 flows into the hydraulic oil tank 11 through the leakage flow path 17. As a result, the discharge flow rate of the hydraulic pump 12 becomes larger than the flow rate required for the hydraulic actuator 2*a*, and the hydraulic pump 12 is operated at a higher rotational frequency than when the leakage flow path 17 is not included. As a result, the drive torque of the hydraulic pump 12 is improved in stability, and stable pressure control/low rate control can be performed.

In addition, the decrease in the rotational frequency of the hydraulic pump 12 in the pressure holding state is caused by clogging of the leakage flow path 17. Therefore, when determining that the hydraulic circuit 10 is abnormal based on the rotational frequency of the hydraulic pump 12 in the pressure holding state becoming less than the predetermined second determination rotational frequency N2, the abnormality determination unit 25 can identify that there is clogging in the leakage flow path 17.

When the rotational frequency of the hydraulic pump 12 becomes less than the predetermined second determination rotational frequency N2 in a state in which the hydraulic pump 12 is controlled to hold the discharge pressure detected by the pressure sensor 16 at a predetermined pressure while the valve 15 is not blocking the flow of the hydraulic oil in the discharge flow path 14, the abnormality determination unit 25 of the present embodiment determines that the hydraulic circuit 10 or any one of the hydraulic circuits of the main machine 2 is abnormal. In this case, the abnormality determination unit 25 of the present embodiment determines whether the hydraulic circuit 10 in the pressure holding state is abnormal or not. When the determination result indicates that the hydraulic circuit 10 is abnormal, the abnormality determination unit 25 can identify that there is clogging in the leakage flow path 17. On the other hand, when the determination result indicates that the hydraulic circuit 10 is not abnormal, the abnormality determination unit 25 determines that the hydraulic circuit of the main machine 2 is abnormal. As a result, when there is a change in the rotational frequency of the hydraulic pump 12 in the state in which the hydraulic pump 12 is controlled to hold. the discharge pressure detected by the pressure sensor 16 at a predetermined pressure while the valve 15 is not blocking the flow of the hydraulic oil in the discharge flow path 14. it can be identified which of the hydraulic unit 1 and the main machine 2 causes the change.

According to the present embodiment, the control device 20 determines the state of the hydraulic circuit 10 in the abnormality determination unit 25 when the monitor signal indicates that the operating state of the valve 15 is blocking the flow of the hydraulic oil in the discharge flow path 14. As a result, the control device 20 determines whether the hydraulic circuit 10 is abnormal or not while the valve 15 is reliably blocking the flow of the hydraulic oil, so that the determination can be improved in reliability.

According to the present embodiment, the correction unit 27 corrects the flow rate set value Qa such that when the hydraulic oil leaks in the hydraulic pump 12, the actual discharge flow rate is held at a predetermined flow rate in the flow rate control.

As a result, the hydraulic pump 12 can supply the hydraulic oil at a desired flow rate to the hydraulic actuator 2*a*, so that a decrease in the performance of the hydraulic actuator 2*a* can be suppressed.

According to the embodiment, a shut-off valve with less leakage than other valves is used as the valve 15, so that the determination of the abnormality of the hydraulic circuit 10 by the control device 20 can be improved in reliability.

In the present embodiment, the abnormality determination unit 25 determines the state of the hydraulic circuit 10 based on the rotational frequency of the hydraulic pump 12, but may determine the state based on the discharge flow rate of the hydraulic pump 12 calculated from the rotational frequency of the hydraulic pump 12. Specifically, when the discharge flow rate of the hydraulic pump 12 calculated from the rotational frequency of the hydraulic pump 12 exceeds a predetermined first determination discharge flow rate Q1 corresponding to the first determination rotational frequency N1 in the pressure holding state, the abnormality determination unit 25 determines that the hydraulic circuit 10 is abnormal. In addition, when the discharge flow rate of the hydraulic pump 12 calculated from the rotational frequency of the hydraulic pump 12 becomes less than a predetermined second determination discharge flow rate Q2 corresponding to the second determination rotational frequency N2 in the pressure holding state, the abnormality determination unit 25 determines that the hydraulic circuit 10 is abnormal. The first determination discharge flow rate Q1 is set to be larger than a normal discharge flow rate Qb corresponding to the normal rotational frequency Na by a predetermined flow rate, The second determination discharge flow rate Q2 is set to be less than the normal discharge flow rate Qb corresponding to the normal rotational frequency Na by a predetermined flow rate.

First Modification

Figure 5:
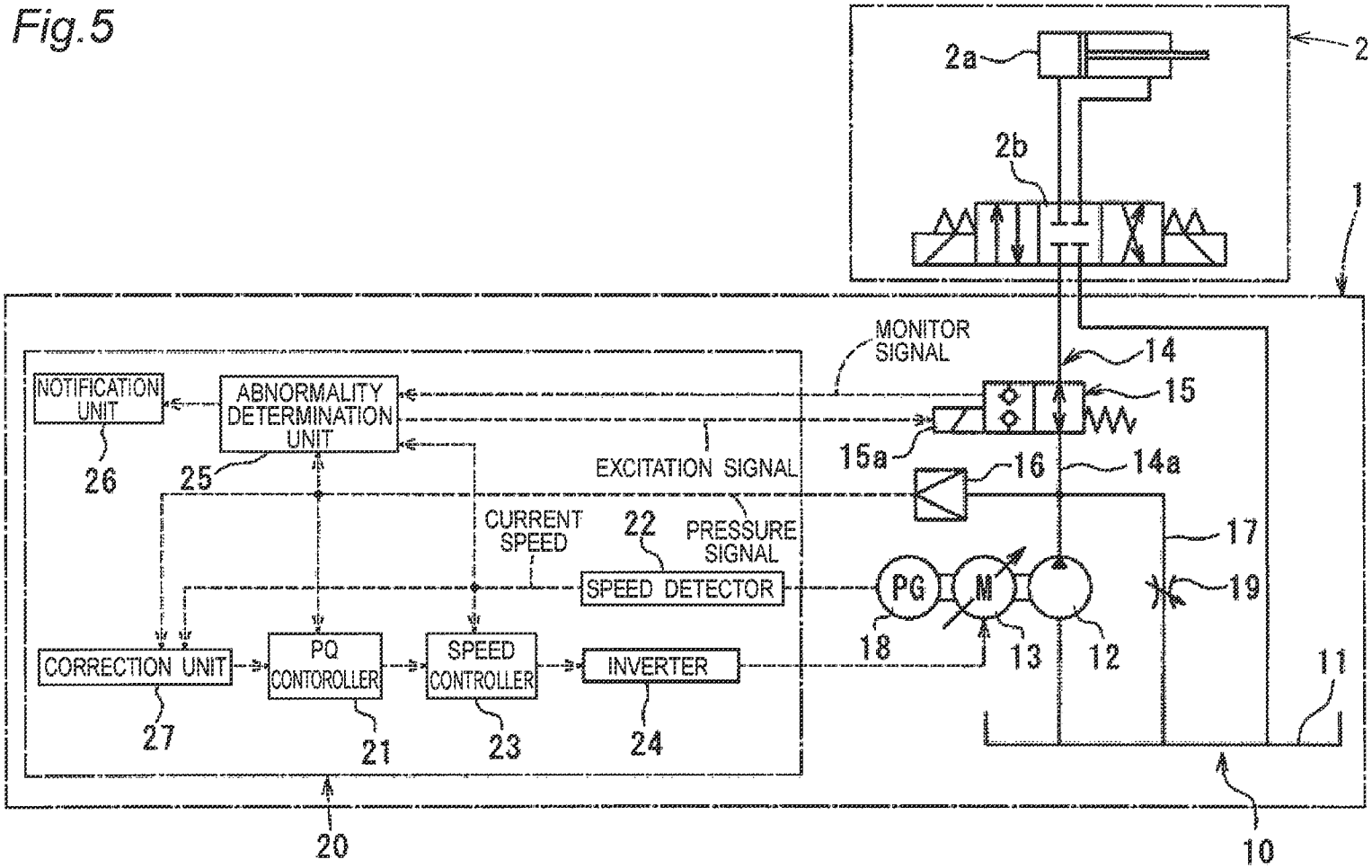
FIG. 5 is a circuit diagram showing a configuration of a hydraulic unit according to a first modification of the first embodiment.

FIG. 5 is a circuit diagram showing a configuration of the hydraulic unit 1 according to a first modification of the first embodiment. With reference to FIG. 5, the flow rate control valve 19 of the hydraulic unit 1 according to the first modification is a flow rate adjustment valve.

The first modification exhibits the same operational effects as those of the first embodiment.

Second Modification

Figure 6:
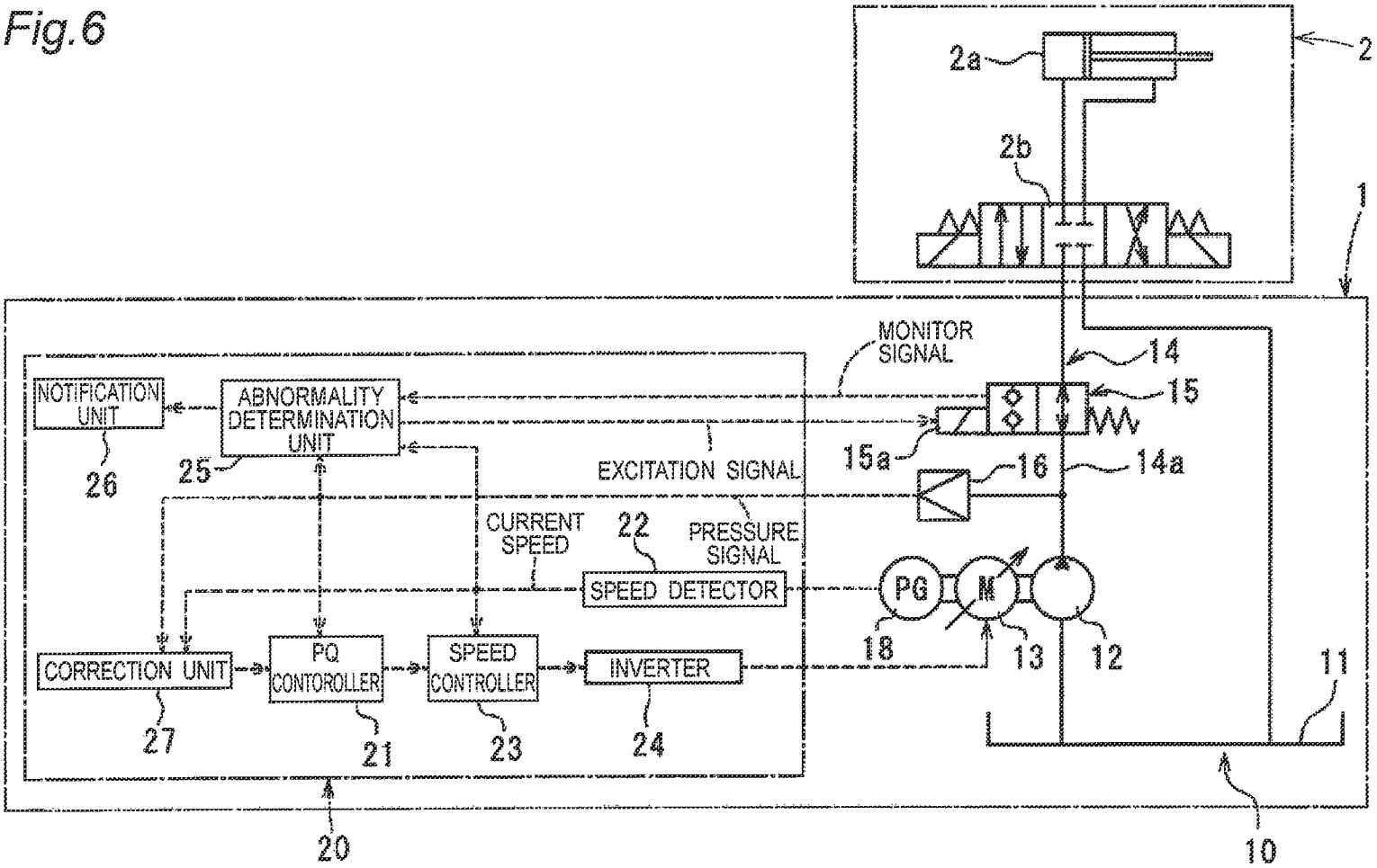
FIG. 6 is a circuit diagram showing a configuration of a hydraulic unit according to a second modification of the first embodiment.

FIG. 6 is a circuit diagram showing a configuration of the hydraulic unit 1 according to a second modification of the first embodiment. With reference to FIG. 6, the hydraulic circuit 10 of the hydraulic unit 1 according to the second modification does not include the leakage flow path.

The second modification exhibits the same operational effects as those of the first embodiment.

SECOND EMBODIMENT

The hydraulic unit 1 of a second embodiment has the same configuration as that of the first embodiment except that a current sensor for measuring a motor current t of the motor 13 is provided, and the description of the first embodiment referring to FIGS. 1 to 4 is applied to the second embodiment, In the second embodiment, components similar to those of the first embodiment will be denoted by the same reference signs, and detailed description thereof will he omitted.

The motor 13 of the present embodiment is provided with a current sensor (e.g., a clamp meter) (not shown) that measures the motor current of the motor 13. The current sensor according to the present embodiment is an example of the motor detector according to the present disclosure.

To the abnormality determination unit 25 of the present embodiment, a motor current of the motor 13 detected by the current sensor is input in addition to the discharge pressure detected by the pressure sensor 16 and the rotational frequency of the motor 13 detected by the speed detector 22.

The abnormality determination unit 25 of the present embodiment determines whether the hydraulic circuit 10 is abnormal or not from the load state of the motor 13 in addition to the determination of the abnormality of the hydraulic circuit 10 based on the rotational frequency of the hydraulic pump 12. Specifically, the abnormality determination unit 25 of the present embodiment determines whether the hydraulic circuit 10 is abnormal or not from the motor current of the motor 13 in addition to the determination of the abnormality of the hydraulic circuit 10 based on the rotational frequency of the hydraulic pump 12.

In the present embodiment, when the rotational frequency of the hydraulic pump 12 exceeds the predetermined first determination rotational frequency N1 in the pressure holding state and when the motor current of the motor 13 becomes higher than a predetermined determination current in the pressure holding state, the abnormality determination unit 25 determines that the hydraulic circuit 10 is abnormal.

The hydraulic unit 1 of the second embodiment exhibits the same operational effects as those of the first embodiment.

In addition, according to the present embodiment, the abnormality of the hydraulic circuit 10 is determined from the motor current of the motor 13 in addition to the determination of the abnormality of the hydraulic circuit 10 based on the rotational frequency of the hydraulic pump 12, so that the determination of the abnormality of the hydraulic circuit 10 can be improved in accuracy.

In the second embodiment, the abnormality of the hydraulic circuit 10 is determined by using the motor current of the motor 13, but instead of the motor current of the motor 13, the abnormality of the hydraulic circuit 10 may be determined by using the winding temperature of the motor 13. In this case, the motor 13 is provided with a temperature thermistor (not shown) that detects the winding temperature of the motor 13. When the rotational frequency of the hydraulic pump 12 exceeds the predetermined first determination rotational frequency N1 in the pressure holding state and when the winding temperature of the motor 13 becomes higher than a predetermined determination temperature in the pressure holding state, the abnormality determination unit 25 determined that the hydraulic circuit 10 is abnormal. The temperature thermistor according to the present embodiment is the motor detector according to the present disclosure.

According to this configuration, the winding temperature of the motor 13 is directly measured, so that the configuration is effective especially when the main machine 2 to which the hydraulic unit 1 is to he attached is a machine an injection molding machine) that is frequently accelerated and decelerated.

THIRD EMBODIMENT

A hydraulic unit 101 of a third embodiment has the same configuration as the hydraulic unit 1 of the first embodiment except that a hydraulic pump 112 is a variable displacement pump, and the description of the first embodiment referring to FIG. 2 is applied to the third embodiment. In the third embodiment, components similar to those of the second embodiment will be denoted by the same reference signs, and detailed description thereof will be omitted.

Figure 7:
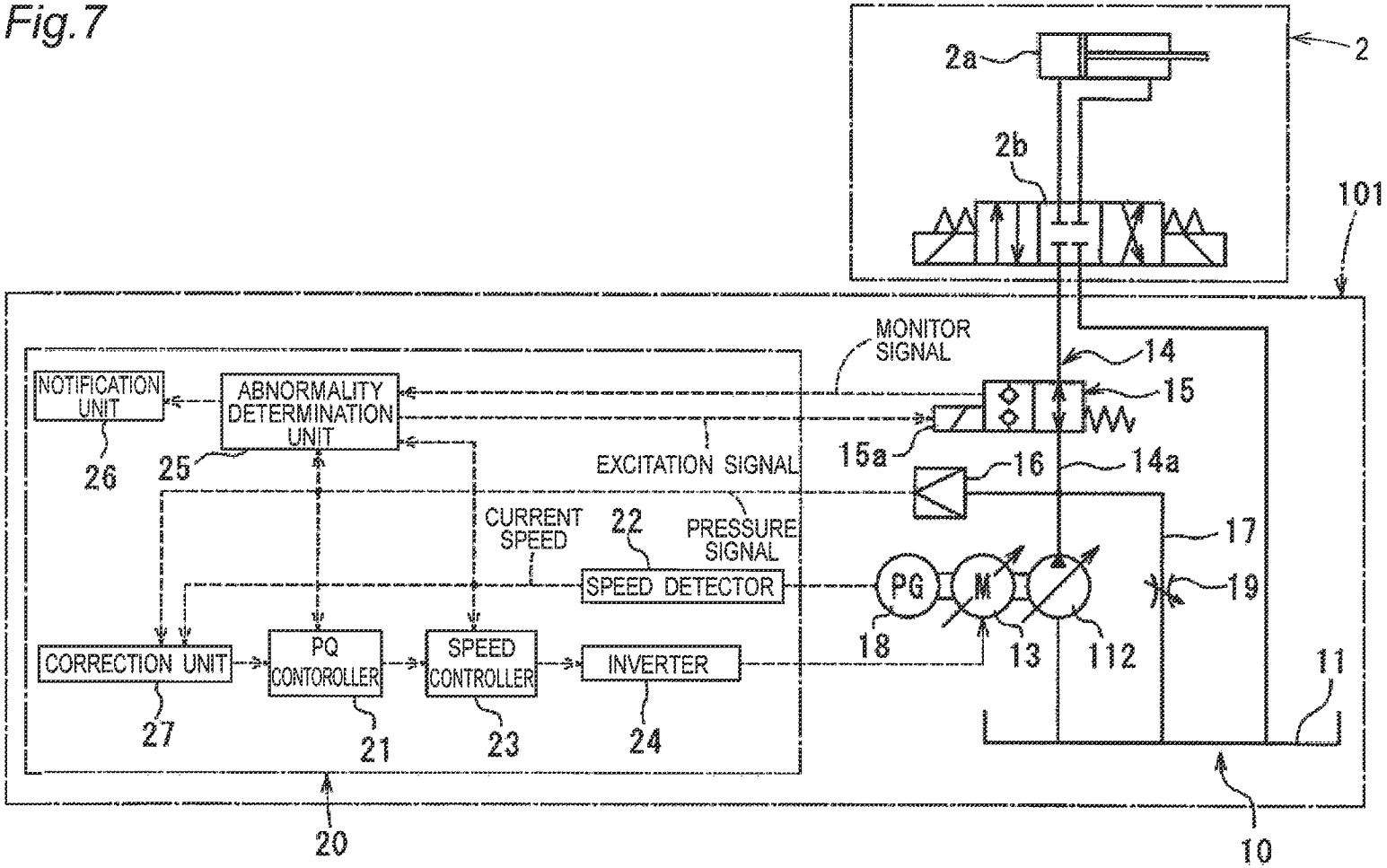
FIG. 7 is a circuit diagram showing a configuration of a hydraulic unit according to a third embodiment of the present disclosure.

FIG. 7 is a circuit diagram showing the configuration of the hydraulic unit 101 according to the third embodiment.

With reference to FIG. 7, the hydraulic pump 112 of the hydraulic unit 101 of the present embodiment is a variable displacement pump. In addition, the hydraulic pump 112 of the present embodiment has a built-in flow rate sensor (not shown) for detecting the discharge flow rate of the hydraulic pump 112. Alternatively, the hydraulic pump 112 may he configured such that the discharge flow rate can he mechanically controlled according to a load pressure.

With reference to FIG. 2, in the flow rate control, the variable displacement mechanism of the hydraulic pump 112 is controlled or the rotational frequency of the motor 13 (rotational frequency of the hydraulic pump 12) is controlled such that the discharge flow rate of the hydraulic pump 112 becomes the flow rate set value Qa. In the present embodiment, the discharge flow rate of the hydraulic pump 112 is detected by the flow rate sensor built in the hydraulic pump 112, or calculated by the product of the pump displacement (discharge flow amount per revolution) set by a discharge flow rate adjustment screw or the like and the rotational frequency of the motor 13. In addition, in the pressure control, the discharge pressure of the hydraulic pump 112 is controlled by the variable displacement mechanism of the hydraulic pump 112 such that the discharge pressure becomes the pressure set value Pa, and the rotational frequency of the motor 13 (rotational frequency of the hydraulic pump 12) is controlled to be reduced in order to reduce power consumption after the pressure is stabilized.

(Determination of State of Hydraulic Circuit)

Figure 8:
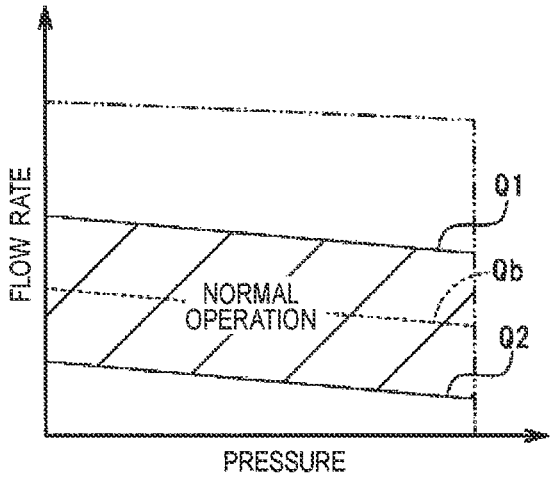
FIG. 8 is a diagram showing a relationship between a discharge pressure and a discharge flow rate of a hydraulic pump in a pressure holding state according to the third embodiment.

FIG. 8 is a diagram for explaining the determination of the state of the hydraulic circuit 10 by the abnormality determination unit 25 of the present embodiment. In FIG. 8, the vertical axis represents the discharge flow rate of the hydraulic pump 112 detected by the flow rate sensor or calculated by the product of the pump displacement set by a discharge flow rate adjustment screw or the like and the rotational frequency of the motor 13. In FIG. 8, the horizontal axis represents the discharge pressure of the hydraulic pump 112.

With reference to FIG. 8, the abnormality determination unit 25 determines in the pressure holding state whether the hydraulic circuit 10 is abnormal or not. Specifically, when the discharge flow rate of the hydraulic pump 112 detected by the flow rate sensor exceeds the predetermined first determination discharge flow rate Q1 in the pressure holding state, as shown in FIG. 8, the abnormality determination unit 25 of the present embodiment determines in the pressure holding state that the hydraulic circuit 10 is abnormal.

When it is determined by the abnormality determination unit 25 that the hydraulic circuit 10 is abnormal, the notification unit 26 notifies the abnormality of the hydraulic circuit 10.

In addition, when the discharge flow rate of the hydraulic pump 112 detected by the flow rate sensor becomes less than the predetermined second determination discharge flow rate Q2 in the pressure holding state, the abnormality determination unit 25 of the present embodiment determines in the pressure holding state that the hydraulic circuit 10 is abnormal.

The third embodiment exhibits the same operational effects as those of the first embodiment.

In addition, in the present embodiment, the hydraulic pump 112 is a variable displacement pump, but the present disclosure is not limited thereto. The hydraulic pump 112 may be a fixed displacement pump with a built-in flow rate sensor.

Although the embodiments have been described above, it will be understood that various changes in form and details can be made without departing from the spirit and scope of the claims.

For example, in the first to third embodiments, the motor 13 is an IPM motor, but the motor 13 is not limited thereto and may be a servomotor. In this case, the hydraulic unit includes a servo amplifier for driving the motor 13 instead of the inverter 24.

In addition, for example, in the first to third embodiments, the valve according to the present disclosure is a shut-off valve, but the valve is not limited thereto and may be a valve having another configuration.

In the first to third embodiments, the control device 20 controls the valve 15, but the present disclosure is not limited thereto. A host control device (e.g., a programmable logic controller (PLC) of a machine tool, a press machine, or the like to which the hydraulic unit is attached) may control the valve 15. In this case, a signal that controls the valve may he input to both the valve and the control device from the host control device, or a monitor signal indicating the operating state of the valve may be input to the control device. As a result, the control device can determine whether the hydraulic circuit is abnormal or not.

What is claimed is:

1. A hydraulic unit comprising:

a hydraulic circuit fluidly connected to a hydraulic actuator; and a control device configured to control the hydraulic circuit, the hydraulic circuit including a hydraulic oil tank configured to store hydraulic oil, a hydraulic pump configured to supply the hydraulic oil to the hydraulic actuator from the hydraulic oil tank, a discharge flow path that fluidly connects a discharge side of the hydraulic pump to the hydraulic actuator, a valve configured to block a flow of the hydraulic oil in the discharge flow path, and a pressure sensor configured to detect a pressure of the hydraulic oil in a flow path portion between the valve and the hydraulic pump of the discharge flow path, when a rotational frequency of the hydraulic pump exceeds a predetermined first determination rotational frequency or when a discharge flow rate of the hydraulic pump exceeds a predetermined first determination discharge flow rate, in a pressure holding state in which the hydraulic pump is controlled such that the pressure detected by the pressure sensor is maintained at a predetermined pressure while the valve is blocking the flow of the hydraulic oil, the control device determines that the hydraulic circuit is abnormal.

2. The hydraulic unit according to claim 1, further comprising:

a leakage flow path that fluidly connects the flow path portion of the discharge flow path to the hydraulic oil tank.

3. The hydraulic unit according to claim 2, wherein when the rotational frequency of the hydraulic pump becomes less than a predetermined second determination rotational frequency lower than the first determination rotational frequency or when the discharge flow rate of the hydraulic pump becomes less than a predetermined second determination discharge flow rate lower than the first determination discharge flow rate, in the pressure holding state, the control device determines that the hydraulic circuit is abnormal.

4. The hydraulic unit according to claim 1, wherein the valve is configured to send to the control device a monitor signal indicating an operating state of the valve.

5. The hydraulic unit according to claim 1, further comprising:

a motor configured to drive the hydraulic pump; and a motor detector configured to detect a motor current of the motor or a winding temperature of the motor, the control device determines in the pressure holding state whether the hydraulic circuit is abnormal based on the motor current of the motor or the winding temperature of the motor detected by the motor detector.

6. The hydraulic unit according to claim 1, wherein:

the control device is configured to execute a flow rate control in which the rotational frequency of the hydraulic pump is controlled such that the discharge flow rate of the hydraulic pump becomes a flow rate set value, and when the rotational frequency of the hydraulic pump changes, in the pressure holding state, with respect to a normal rotational frequency corresponding to the predetermined pressure, the control device corrects the flow rate set value depending on the change in the rotational frequency of the hydraulic pump with respect to the normal rotational frequency.

7. The hydraulic unit according to claim 1, wherein the valve is a shut-off valve.

8. The hydraulic unit according to claim 2, wherein the valve is configured to send to the control device a monitor signal indicating an operating state of the valve.

9. The hydraulic unit according to claim 2, further comprising:

a motor configured to drive the hydraulic pump; and a motor detector configured to detect a motor current of the motor or a winding temperature of the motor, the control device determines in the pressure holding state whether the hydraulic circuit is abnormal based on the motor current of the motor or the winding temperature of the motor detected by the motor detector.

10. The hydraulic unit according to claim 2, wherein:

the control device is configured to execute a flow rate control in which the rotational frequency of the hydraulic pump is controlled such that the discharge flow rate of the hydraulic pump becomes a flow rate set value, and when the rotational frequency of the hydraulic pump changes, in the pressure holding state, with respect to a normal rotational frequency corresponding to the predetermined pressure, the control device corrects the flow rate set value depending on the change in the rotational frequency of the hydraulic pump with respect to the normal rotational frequency.

11. The hydraulic unit according to claim 2, wherein the valve is a shut-off valve.

12. The hydraulic unit according to claim 4, further comprising:

a motor configured to drive the hydraulic pump; and a motor detector configured to detect a motor current of the motor or a winding temperature of the motor, the control device determines in the pressure holding state whether the hydraulic circuit is abnormal based on the motor current of the motor or the winding temperature of the motor detected by the motor detector.

13. The hydraulic unit according to claim 4, wherein:

the control device is configured to execute a flow rate control in which the rotational frequency of the hydraulic pump is controlled such that the discharge flow rate of the hydraulic pump becomes a flow rate set value, and when the rotational frequency of the hydraulic pump changes, in the pressure holding state, with respect to a normal rotational frequency corresponding to the predetermined pressure, the control device corrects the flow rate set value depending on the change in the rotational frequency of the hydraulic pump with respect to the normal rotational frequency.

14. The hydraulic unit according to claim 4, wherein the valve is a shut-off valve.

15. The hydraulic unit according to claim 5, wherein:

the control device is configured to execute a flow rate control in which the rotational frequency of the hydraulic pump is controlled such that the discharge flow rate of the hydraulic pump becomes a flow rate set value, and when the rotational frequency of the hydraulic pump changes, in the pressure holding state, with respect to a normal rotational frequency corresponding to the predetermined pressure, the control device corrects the flow rate set value depending on the change in the rotational frequency of the hydraulic pump with respect to the normal rotational frequency.

16. The hydraulic unit according to claim 5, wherein the valve is a shut-off valve.

17. The hydraulic unit according to claim 6, wherein the valve is a shut-off valve.

* * * * *